US005297748A

United States Patent [19]

LeCompte

[11] Patent Number: 5,297,748

[45] Date of Patent: Mar. 29, 1994

[54] FILAMENT AUTOWINDER WITH FAULT DETECTION

[75] Inventor: George W. LeCompte, Tuscon, Ariz.

[73] Assignee: Hughes Aircraft Company, Los Angeles, Calif.

[21] Appl. No.: 23,156

[22] Filed: Feb. 25, 1993

Related U.S. Application Data

[63] Continuation of Ser. No. 739,566, Aug. 2, 1991, abandoned.

[51] Int. Cl.[5] ..... B65H 54/00; B65H 57/28

[52] U.S. Cl. ..... 242/18 R; 242/18 G; 242/158 R

[58] Field of Search ..... 242/18 R, 25 R, 158 R, 242/18 G

[56] References Cited

U.S. PATENT DOCUMENTS

| | | | |
|---|---|---|---|
| 3,565,357 | 2/1971 | Noguchi | 242/25 R |
| 3,604,647 | 9/1971 | Le Compte | 242/25 R |
| 3,779,480 | 12/1973 | Combou | 242/158 R |
| 3,951,355 | 4/1976 | Morioka et al. | 242/158 R |
| 4,428,540 | 1/1984 | Calcagno et al. | 242/25 R |
| 4,570,875 | 2/1986 | Buluschek | 242/158 R |
| 4,629,145 | 12/1986 | Graham | 242/25 R |
| 4,725,010 | 2/1988 | Lothamer | 242/25 R X |
| 4,920,738 | 5/1990 | White et al. | 242/18 R X |

*Primary Examiner*—Daniel P. Stodola
*Assistant Examiner*—Michael R. Mansen

[57] ABSTRACT

In apparatus for winding a filament (12) onto a bobbin (16), a free arm follower (32, 64) with guide pulleys (46, 48, 76, 78) is provided for both the bobbin (16) and filament supply spool (14). The free arm followers swing in respective arcs parallel to the longitudinal axes of the supply spool (14) and bobbin (16) to produce consistent and uniform filament winding. A quadrature sensor (90) determines the number of actual windings laid down in each layer which are compared (94) with predetermined winding number and if the numbers do not coincide, a stop for flaw circuit (102) stops the spindle motors (28, 82) to enable winding flaw correction. A layer counter (104) energizes a lead angle driver (106) to provide correct winding lead on changing winding direction with each new layer.

8 Claims, 3 Drawing Sheets

FILAMENT AUTOWINDER WITH FAULT DETECTION

This is a continuation of application Ser. No. 07/739,566 filed Aug. 2, 1991, now abandoned.

BACKGROUND

1. Field of the Invention

The present invention relates generally to the winding of a filament onto a bobbin or canister, and, more particularly, to a method and apparatus for controlling the winding of a filament onto a bobbin or canister with great consistency.

2. Description of Related Art

There are many requirements for a filament to be wound onto a bobbin or canister in uniform winding layers where any inconsistencies, such as climb back or gapping, make the final winding unacceptable. Exemplary of one such use is where a wound optical fiber or metal wire filament is dispensed during flight of a vehicle to maintain a data link with launch site equipment. In such use, an incorrectly or inaccurately wound bobbin may induce stress in the filament during dispense that can cause it to break or be stressed to the point that transmission efficiency of data is substantially reduced. Moreover, in the case of an optical fiber whose dimensions may be in the order of thousandths of an inch, the winding of a bobbin is a relatively difficult proposition in that because of the fiber small cross-sectional dimensions inconsistencies can readily occur.

All known so-called automatic filament winding machines have relatively awkward techniques for transition forming (i.e.) moving from one layer to the next layer) and cross-over control. Some of the known automatic winding equipment contemplates program speed reduction at the end of each layer to alleviate the transition process which is quite costly in labor as well as resulting in production time loss and need for floor space for the extra equipment required.

There are other known systems that operate on a vision principle in which a light beam, such as a laser, tracks the winding filament and on detecting variations from norm shuts down the winding operation to enable correcting inconsistencies. Such a system is disclosed in copending U.S. patent application Ser. No. 07/669,251, BOBBIN WINDING CONTROL by B. F. Berlin et al. filed Mar. 14, 1991 and assigned to the same assignee as the present application. This vision system offers prospects of being highly effective in use even though it utilizes relatively expensive equipment, the cost of which may be prohibitive under certain circumstances.

U.S. Pat. No. 3,604,647, MACHINE FOR WINDING BOBBINS by George W. LeCompte et al. and assigned to the same assignee as the present application discloses wire winding apparatus having a freely oscillating arm mounted on a reversing plate. The wire on leaving a pulley located on the outer end of the arm is wound onto a bobbin with the arm freely pivoting to follow the winding as it is formed on a layer. Solenoids alternately move the reversing plate to each of two limits as a layer is finished.

OBJECTS AND SUMMARY OF THE INVENTION

It is a primary object of the present invention to provide a method and apparatus for precisely determining the last winding on a winding layer located immediately adjacent a bobbin flange.

Another object of the invention is the provision of the method and apparatus as in the preceding object in which a preset number of turns for a given layer is compared with layer end sensing and winding is stopped on detection of a layer turns number discrepancy.

Yet another object is the provision of method and apparatus as in the previous objects additionally including winding angle control for the bobbin.

Apparatus for accomplishing the method of the present invention includes, for both the filament source spool and the winding bobbin, a free arm follower that swings in an arc parallel to the longitudinal axis of the filament spool and spaced above the spool. During winding, the filament drawn off the source spool passes over guide pulleys on the free arm follower and onto a further guide pulley which is arranged generally at 90° to the free arm follower. Filament passing over this further pulley then engages a tension control dancer after which it then passes over a similar set of pulleys, and free arm follower, in reverse order, provided for the winding bobbin.

The free arm followers enable consistent and ready following or tracking of the filament takeoff from the source spool and laying down of the filament winding on the bobbin in a consistently accurate and continuous uniform angle to the winding axis which prevents inducing unusual stress into the filament and insures that the filament will be laid down on the bobbin in correct manner. A sensor on the spindle senses each rotation of the filament bobbin and feeds sensing signals into an up-down counter in order to determine when a predetermined amount of winding has been provided for each layer. That is, each individual layer on the bobbin is supposed to have this predetermined number of windings and an end of layer signal is fed into a comparator where it is compared with the actual stored turns per layer as indexed into the system.

Photoelectric sensors are directed towards the position immediately adjacent each of the bobbin flanges and energized at appropriate times in order to detect the last winding on each layer and compare it with the actual last winding indication as determined by the pickoff count. If the photoelectric sensing and pickoff count coincide, then winding continues. However, if there is a difference detected, a circuit will be energized to stop the winding bobbin spindle drive so that the flaw can be eliminated.

DESCRIPTION OF PREFERRED EMBODIMENT

Figure 1:
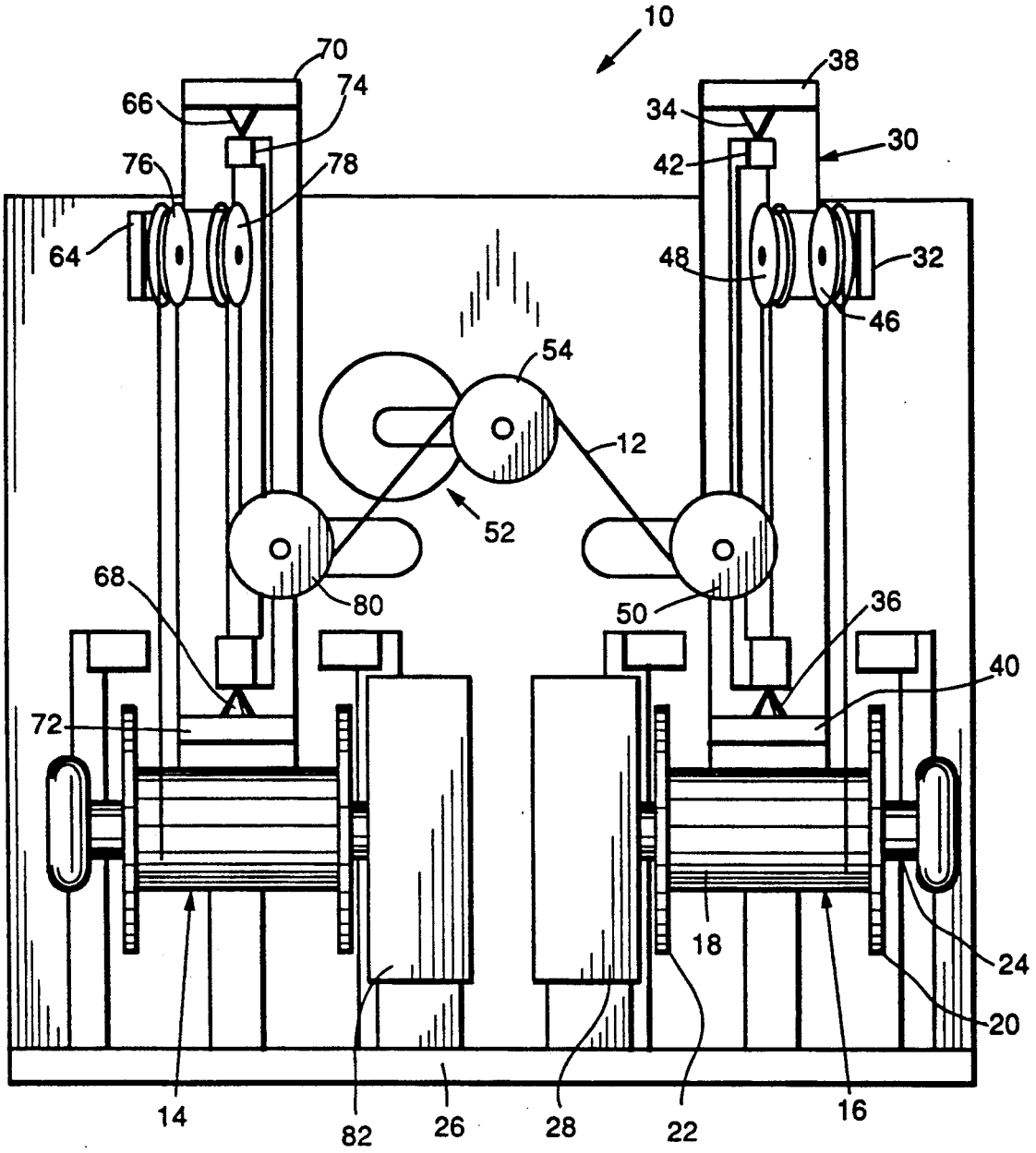
FIG. 1 shows a front elevational view of the apparatus of the subject invention for practicing the winding method thereof.

With reference now to the drawing and particularly FIG. 1, the apparatus to be described enumerated generally as 10 operates to remove filament (e.g., optical fiber) 12 from a supply spool 14 and wind it onto a bobbin 16 having a generally cylindrical base or mandrel and with the wound pack 18 located accurately between two opposite end flanges 20 and 22.

Since the filament handling apparatus for winding the bobbin 16 and for removing the filament from the supply spool 14 are highly similar only that apparatus directly associated with winding filament onto the bobbin will be described in detail.

The bobbin 16 is mounted on a spindle 24 having its axis horizontally disposed with respect to a ground plane 26 and which spindle is driven by a spindle motor 28 during winding of the pack 18.

Figure 2:
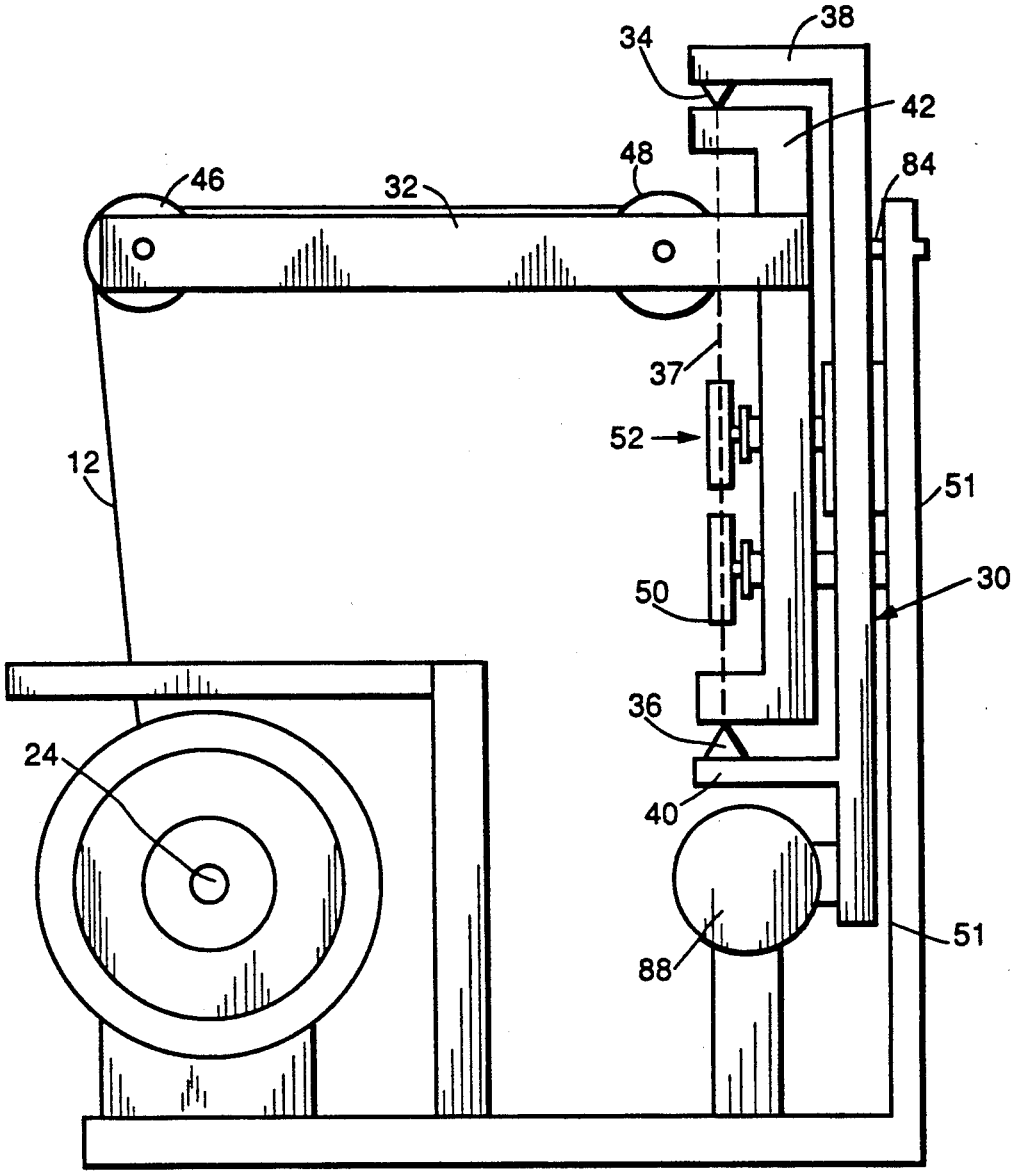
FIG. 2 depicts a side elevational view taken along the line 2—2 of FIG. 1.

A member 30 adjacent the bobbin 16 extends generally vertically and has a free-arm follower 32 pivotally mounted to the member 30. More particularly, the member 30 includes first and second pivots 34 and 36 on facing end portions of arms 38 and 40, respectively (FIG. 2). An armature 42 is mounted between the first and second pivots 34 and 36 so as to pivot about the center line drawn through the pivots as an axis 37. The free-arm follower 32 has one end secured to the armature 42 so as to extend substantially normally therefrom with its outer end located above the bobbin 16. First and second guide pulleys 48 and 46 are rotatably mounted to the same side of the follower arm at points, respectively, adjacent the frame and adjacent the outer end of the follower arm. Specifically, guide pulley 48 aligns the incoming filament 12 along the pivot line axis 37.

Refering simultaneously to both FIGS. 1 and 2, a further guide pulley 50 is rotatably mounted to a generally vertical wall 51 at a point adjacent the lower end of the armature 42 on the side of the armature closer to the supply spool. Pulley 50 is arranged to rotate about an axis substantially 90 degrees to the bobbin spindle axis and with its circumferential edge generally aligned with the pivot axis 37. A so-called tension control dancer 52 which includes a rotatable pulley 54 is mounted to the wall 51 approximately midway between the supply spool and bobbin with the axis of rotation parallel to that of pulley 50.

As can be seen best in FIG. 1, the filament 12 that is taken off the supply spool passes up and along a circumferential recess in the tension control dancer pulley 54, downwardly and under the recess in pulley 50, upwardly and over a similar recess in guide pulley 48, over recess in pulley 46 and downward to be wound onto the bobbin 16.

The bobbin 16 on which the filament wound pack 18 is formed also includes first and second flanges 20 and 22 defining the pack length and which bobbin is mounted onto the spindle 24 that is driven by motor 28. As the motor 28 provides the impetus for winding, the free-arm follower pivots so that the winding being laid down is accomplished by the filament extending preferably at substantially 0 degrees of attack and along a substantially vertical path from pulley 46 to the point at which the filament first contacts the pack 18. As will be described later, the apparatus of the invention includes means for adjusting the winding attack angle and maintaining any preset angle.

As already noted, the fiber guide apparatus from the supply spool 14 is identical to that described in connection with the supply spool 14 and, therefore, will not be described in detail other than to list the corresponding parts and reference numerals, namely, free-arm follower 64, pivots 66 and 68, arms 70 and 72; armature 74; and guide pulleys 76, 78, and 80.

With respect to operation of the apparatus of the invention described to this point, filament that is being removed from the supply spool 14 moves upwardly over the free-arm guide pulleys 76 and 78, downward to the change of direction pulley 80, over the tension control dancer and then passes over pulleys 50, 48 and 46 (in the order recited) to be directed downwardly and wound onto the bobbin 16. Without the requirement for driving action, the follower arms for both the supply spool and the bobbin move along the direction parallel to the axis of both the spindle and the bobbin as the new pack is wound and simultaneously as the filament is being removed from the supply spool. In this way, the filament is not only protected against undue stress by, for example, pulling the filament at an angle to the surface with which it is either being removed or mounted, but it also insures that the filament is wound in a uniform manner on the bobbin. Drive is applied to both a supply spool spindle motor 82 and the bobbin motor 28 in order to aid the winding as well as the unwinding of the filament and keep filament stress to a minimum.

The tension control dancer means 52 accomplishes filament tension sensing by conventional means and generates a signal to control the supply spindle motor 82 for maintaining winding filament at a predetermined tension.

With reference now to especially FIG. 2, it is seen that member 30 is rotatably mounted onto a pivot rod 84 secured to the wall 51. At the lower end of the member 30, there is provided a lead angle actuator 88 which, on being energized as will be described, pivots the member 30 in a generally vertical plane about the rod 84 as an axis, pivots 34, 36 and armature member 42 to adjust the lead angle or attack angle of the filament 12 being wound onto the bobbin pack. This adjustment may be found necessary in order to insure consistent uniform winding and to reduce the possibility of gapping or climb-back which can result if too large a filament winding angle of attack is employed.

Figure 3:
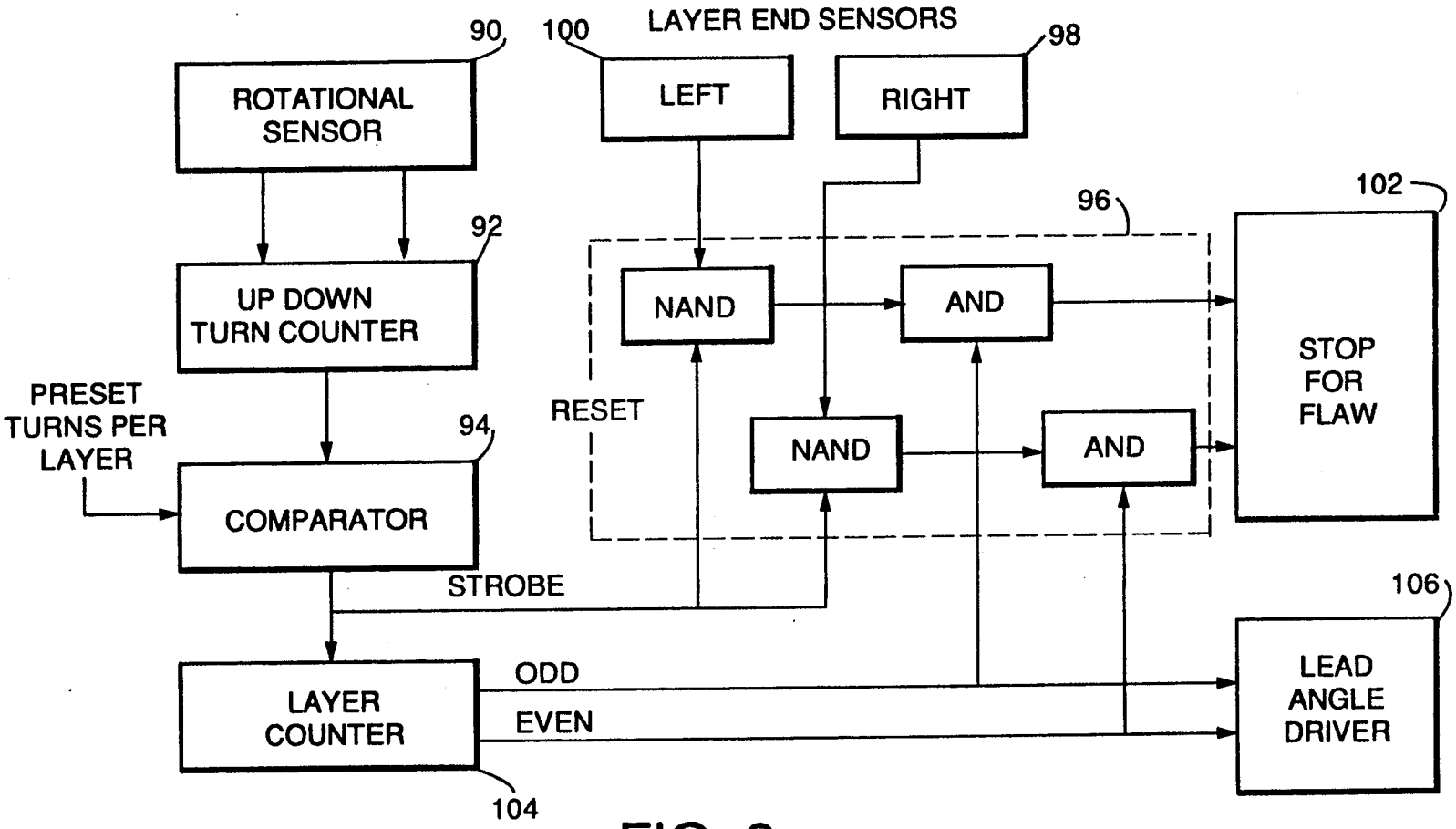
FIG. 3 shows a function block schematic of the circuit for the apparatus of the present invention.

Turning now to FIG. 3, a conventional bobbin shaft pickoff 90 (e.g., magnetic piece secured to bobbin shaft induces electric signal in a coil as it moves past) located immediately adjacent one of the bobbin flanges develops a signal on each rotation of the bobbin during winding and feeds the signal into an up-down counter 92. Winding of a bobbin is initiated by starting exactly at a flange edge with it being known that it takes a prescribed number of turns for each layer. Accordingly, when the up-down counter reaches the preset amount previously stored in a comparator 94, then a comparator output signal is obtained. The output is then passed through logic circuitry 96 along with signals from layer end or end most turns sensors 98 and 100 (e.g., photoelectric sensors) located at opposite ends of the bobbin and directed to view the last winding turn, that is, the turn immediately adjacent each flange. On the proper count being detected in the comparator at the same time that the last winding turn is detected immediately adjacent the correct flange, then the winding of the pack continues in reverse direction and the up-down counter is reset. However, in the event that the count is incorrect on comparing with the stored prescribed turns per layer, or the correct count occurs at a winding point different from that of the occurrence of the light signal for the last turn on layer, then an output is obtained to a stop for flaw circuit 102 stopping the drive of the spindles and enabling correction of the flaw to be achieved.

The comparator signal on coincidence of the real-time count with the predetermined layer count energizes a layer counter 104 which provides two output signals, the first one identified as "odd" which occurs at the beginning of an odd-numbered winding layer, and a second one referred to as "even" which occurs at the beginning of an even-numbered layer. These odd and even signals impulse a lead angle driver 106 so as to provide the correct lead angle for winding from left-to-right and right-to-left, respectively (FIG. 1).

The described winding apparatus can be substantially automatic in operation, winding back and forth between the two bobbin flanges and only being interrupted in the case of an error occurring (e.g., climb-back, gapping).

Although the invention has been described in connection with a preferred embodiment, it is to be understood that those skilled in the appertaining art may make modifications which come within the spirit of the invention and the ambit of the claims that follow.

What is claimed is:

1. Apparatus for taking a filament from a supply spool and winding it onto a bobbin, comprising:

first free-arm means mounted spaced above the supply spool for swinging movement along a path in a plane generally parallel to a plane including the supply spool axis of rotation;

first rotatable pulley means rotatably mounted on said first free-arm means for guiding filament taken from the supply spool in a generally upwardly direction;

second free-arm means mounted spaced above the bobbin for swinging movement generally parallel to the bobbin winding axis;

second pulley means rotatably mounted on said second free-arm means for guiding filament from the first pulley means and redirecting the filament downwardly to be wound onto the bobbin; and means for drivingly rotating both the supply spool and the bobbin.

2. Apparatus as in claim 1, in which the first and second free-arm means each include an elongated armature member having a longitudinal axis and mounted for pivotal movement about the longitudinal axis; a follower having an end affixed to the armature member and extending transversely away from said armature member; and the first and second pulley means each include a pair of edge recessed pulleys rotatably mounted at spaced apart points along their respective followers with the pulley edge recesses on each follower lying substantially in the same plane.

3. Apparatus as in claim 2, in which there is provided a support member having opposite end portions with surfaces facing one another; first and second pivot means on the support member facing surfaces for pivotably supporting the armature member to freely pivot about an axis formed between the pivot means.

4. Apparatus as in claim 3, in which the support member for the second free-arm means is pivotally mounted providing angular adjustment of the armature member with respect to the bobbin winding axis varying the filament angle of attack on being wound onto the bobbin.

5. Apparatus as in claim 1, in which motor means are provided for driving the supply spool in a direction to control release of filament and for simultaneously driving the bobbin in a direction to wind filament onto the bobbin while maintaining a predetermined filament tension.

6. Apparatus as in claim 5, in which there are further provided means for detecting the last winding turn on each layer and generating a signal on each such detection; means for providing a signal representative of a predetermined number of winding turns being laid down on each winding layer; a comparator receiving the signals from the detecting means and the predetermined number providing means and when lack of coincidence of the signals occurs the motor means are stopped.

7. Apparatus as in claim 1, in which there is further provided tension dancer means located in filament tension measuring relation with the filament after it leaves the first pulley means and before the filament engages the second pulley means.

8. Apparatus as in claim 7, in which the tension dancer means provides a signal corresponding to the filament tension and said signal controls the supply spool drive motor to maintain predetermined filament tension.

* * * * *